US006549137B1

(12) United States Patent
Bruchmann

(10) Patent No.: US 6,549,137 B1
(45) Date of Patent: Apr. 15, 2003

(54) FUSE HOLDER HAVING AN INTEGRATED CONNECTING LINE FOR STATUS INDICATORS

(76) Inventor: Klaus Bruchmann, Am Ölberg 7a, D-96450 Coburg (DE)

( * ) Notice: Subject to any disclaimer, the term of this patent is extended or adjusted under 35 U.S.C. 154(b) by 0 days.

(21) Appl. No.: 09/600,097

(22) PCT Filed: Jan. 7, 1999

(86) PCT No.: PCT/EP99/00052

§ 371 (c)(1),
(2), (4) Date: Jul. 11, 2000

(87) PCT Pub. No.: WO99/35658

PCT Pub. Date: Jul. 15, 1999

(30) Foreign Application Priority Data

Jan. 12, 1998 (DE) ..... 198 00 779

(51) Int. Cl.[7] ..... G08B 21/00

(52) U.S. Cl. ..... 340/638; 361/93.1; 361/104; 361/626; 361/837

(58) Field of Search ..... 340/638, 639, 340/648, 662; 361/160, 104, 206, 626, 88, 93.1, 833, 837; 324/550, 507, 133; 174/52.5, 52.6, 58, 60, 64

(56) References Cited

U.S. PATENT DOCUMENTS

| | | | | | |
|---|---|---|---|---|---|
| 4,641,120 | A | * | 2/1987 | Bonfig et al. | 337/242 |
| 5,002,505 | A | * | 3/1991 | Jones et al. | 439/622 |
| 5,099,199 | A | * | 3/1992 | Carter | 324/550 |
| 5,311,139 | A | * | 5/1994 | Fogal | 324/550 |
| 5,343,192 | A | * | 8/1994 | Yenisey | 340/639 |
| 5,378,931 | A | * | 1/1995 | Bolda et al. | 307/131 |
| 5,561,580 | A | * | 10/1996 | Pounds et al. | 361/104 |
| 5,739,737 | A | * | 4/1998 | Hatton | 337/206 |
| 5,841,337 | A | * | 11/1998 | Douglass | 337/198 |
| 5,894,397 | A | * | 4/1999 | Nelson | 361/160 |
| 5,986,557 | A | * | 11/1999 | Clarke | 340/638 |
| 6,028,512 | A | * | 2/2000 | Schropp et al. | 340/471 |
| 6,054,915 | A | * | 4/2000 | Rowton et al. | 337/216 |
| 6,132,918 | A | * | 10/2000 | Enright et al. | 430/108 |

FOREIGN PATENT DOCUMENTS

| | | |
|---|---|---|
| DE | 31 33 094 C2 | 11/1986 |
| DE | 35 13 833 C2 | 4/1989 |
| DE | 41 27 214 A1 | 2/1993 |
| DE | 297 14 132 U1 | 11/1997 |
| EP | 0 073 032 | 3/1985 |
| EP | WO 86/03054 | 5/1986 |
| EP | 0530 563 A1 | 10/1993 |

* cited by examiner

*Primary Examiner*—Toan Pham
(74) *Attorney, Agent, or Firm*—Wood, Phillips, Katz, Clark & Mortimer

(57) ABSTRACT

The invention relates to a fuse holder for a fuse-link in which a fuse status indicator having a printed circuit board and a glow lamp is fitted. The necessary connecting lines are made of conductive plastic from the top and base contacts of the fuse-link to the printed circuit board of the status indicator. The conductive plastic is injected in channels which are provided therefor and are situated in the housing of the fuse holder.

14 Claims, 2 Drawing Sheets

FUSE HOLDER HAVING AN INTEGRATED CONNECTING LINE FOR STATUS INDICATORS

TECHNICAL FIELD

The invention relates to a fuseholder having a fuse status indicator according to the precharacterizing clause of Patent claim 1. Such a fuseholder is known from DE 41 27 214.5 A1.

BACKGROUND OF THE INVENTION

Electrical fuse assemblies having a fuseholder for insertion into a fuse housing are in widespread use. The fuse link or fuse, the actual protection element, is accommodated in the fuseholder such that it can be replaced. The fuseholder may, for example, be in the form disclosed in DE 34 06 815 A1, or the form disclosed in DE 37 41 743.6 A1. According to Application DE 197 34 234.5, the latter is preferably equipped with a coding tongue, which rests elastically against the foot contact of the fuse link.

A flashing status indicator according to DE 41 27 214.5 A1, which was mentioned above, is in each case fitted in the fuseholder. This status indicator comprises a glow lamp, which is arranged behind a window in the upper part of the fuseholder, and a small board in the vicinity of the glow lamp, with the electronic components such as capacitors, diodes and resistors required to actuate the glow lamp. The status indicator is electrically connected via connecting lines to the head contact and foot contact of the fuse link and, when the glow lamp flashes, this indicates whether the fuse link has been tripped and has blown.

In the past, the electrical connection between the head contact and foot contact of the fuse link and the board of the status indicator was produced by means of small pieces of wire, which were soldered at one end to the board and at the other end to the contact elements which are connected in the fuseholder to the head contact and foot contact of the fuse link.

This arrangement has the disadvantage that the steps for insertion of the pieces of wire into the fuseholder and their soldering during the production of the fuseholder can be carried out only manually. The production process is thus rather complex.

DE 35 13 833 C2 discloses a melting fuse link which has a high cylindrical insulating-material body, in the interior of which a melting conductor is provided between two contact caps arranged at the ends of the insulating body, with a series circuit comprising a high-value resistor and an optoelectronic display device being connected in parallel with the melting conductor. The high-value resistor may comprise an electrically conductive, high-resistance layer or an electrically conductive, high-resistance plastic insert, which extends from one contact cap to the other and rests against the inner surface of the hollow-cylindrical insulating-material body. This arrangement also has the disadvantage that the plastic insert must be inserted in and attached to the insulating-material body separately, although this can be done manually or automatically.

SUMMARY OF THE INVENTION

The invention is based on the object of refining the fuseholder with the built-in status indicator so that the production process is simple. In order to achieve this object, the invention provides a fuseholder having the features of claim 1, and a method for producing a fuseholder having the method steps of claim 7.

According to the invention, this object as stated in the patent claims is achieved in that the connecting lines for the status indicator are no longer composed of wire, but of a conductive plastic for which channels which have accurately predetermined dimensions are provided in the fuseholder, the rest of which is composed of insulating plastic.

The connecting lines for the status indicator can thus easily and quickly be configured by means of so-called two-component injection molding during the process of molding the plastic fuseholder.

The conductive plastic may make contact with the head contact and/or foot contact of the fuse link directly, or indirectly via the metallic connections for the fuse link in the fuseholder.

BRIEF DESCRIPTION OF THE DRAWINGS

Exemplary embodiments of the fuseholder according to the invention and having an integrated connecting line for a status indicator are explained in more detail in the following text with reference to the drawing, in which.

DETAILED DESCRIPTION OF THE PREFERRED EMBODIMENT

Figure 1:
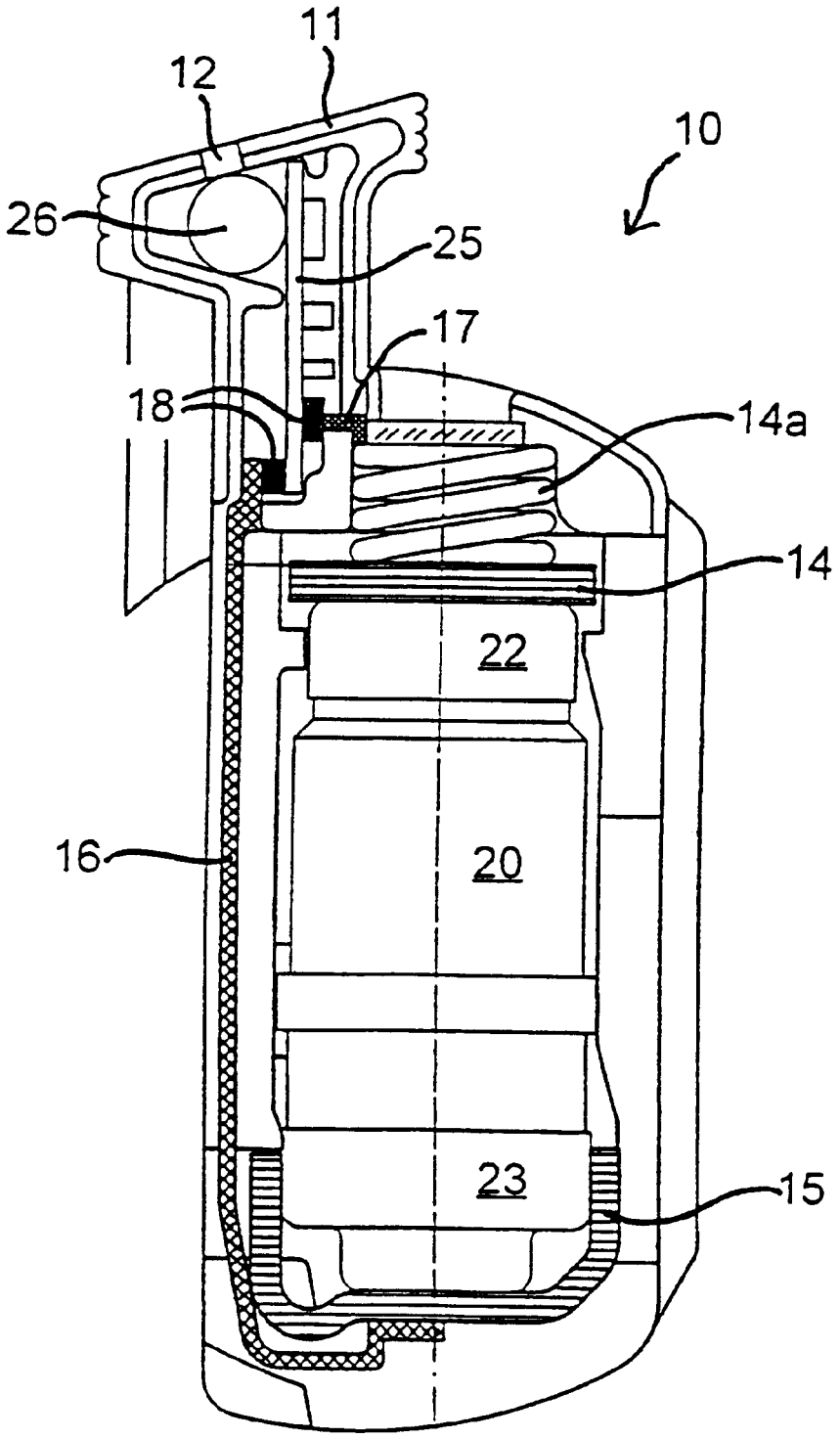
FIG. 1 shows a section view of a first version of a fuseholder having a built-in status indicator.

FIG. 1 shows a section view from the side of a fuseholder 10, as is used in conventional fused switches. In fused switches of this type which are described, for example, in the abovementioned DE 34 06 815 A1, the fuseholder 10 is used in conjunction with the fuse link or fuse 20 which is located in it and, in general, is a melting fuse, not only to protect the load side against short circuits, but also to isolate the load side from the power supply, as is required, for example, when working on the electrical installation. To this end, when the fuseholder 10 is inserted into the housing of the fused switch, it can tilt from a switched-on position to a switched-off position.

The fuseholder 10 has an operating handle 11, in which the board 25 and the glow lamp 26 of a fuse status indicator are accommodated. The glow lamp 26 is fitted behind a window 12 at the front, visible end of the operating handle 11. The electrical circuit of the status indicator, having the diodes, capacitors, resistors, etc. for actuating the glow lamp 26, is essentially located on the board 25 in such a manner that the glow lamp 26 flashes when the fuse link 20 has blown.

The fuse link 20 has a metallic head contact 22 and a metallic foot contact 23. The head contact 22 of the fuse link 20 is connected to a metallic holding and connecting element 14 of the fuseholder 10, and the foot contact 23 of the fuse link 20 is connected to a metallic holding and connecting element 15 of the fuseholder 10. The metallic holding and connecting elements 14, 15 are used firstly to fix the fuse link 20 elastically in the fuseholder 10 such that it can be replaced, for which purpose, for example, the upper holding and connecting element 14 may include a compression springs 14*a* and, secondly, to produce the electrical contact between the fuse link 20 and the corresponding connections in the fused switch when in the switched-on position.

Apart from the metallic holding and connecting elements 14, 15, the broad 25 and the glow lamp 26 of the status indicator and the window 12, the fuseholder 10 (except for the fuse link 20) is composed of plastic, which is molded by injection molding. A channel is provided in the electrically insulating plastic, of which the housing of the fuseholder 10 is essentially composed, in one of the walls of the housing, which runs between the board 25 and the holding and connecting element 15 for the foot contact 23, and this channel is filled with an electrically conductive plastic, forming a first connecting line 16. The connecting line 16, which is composed of the conductive plastic, is formed by means of two-component injection molding; this produces the connection between the board 25 and the holding and connecting element 15 for the foot contact 23 of the fuse link 20.

In the same way, a further channel is provided in another wall of the housing, which runs between the board 25 and the holding and connecting element 14 for the head contact 23, and this channel is filled with the conductive plastic, forming a second connecting line 17. The connecting line 17 produces the connection between the board 25 and the holding and connecting element 14 for the head contact 22 of the fuse link 20.

Instead of the connecting lines 16, 17 making contact with the holding and connecting elements 14, 15, they may alternatively make direct contact with the head and foot contacts 22, 23 of the fuse link 20, for example via projecting tabs, which are formed on the housing of the fuseholder 10 such that, when the fuse link 20 is inserted, they are connected to its head contact 22 and foot contact 23.

The connecting lines 16, 17 are preferably connected to the board 25 via appropriately positioned contact pieces 18, in such a manner that the board 25 need be inserted only into the cavity provided for this purpose in the operating handle 11, with the electrical contact between the board 25 and the connecting lines 16, 17 then being produced automatically.

The channels for the connecting lines 16, 17 may be of such a size that they result in a specific conductivity and a specific resistance by virtue of the channel length and the channel cross section together with the type of conductive plastic provided in each case. The circuit on the board 25 may thus be simplified. Typical resistance of the connecting lines 16, 17 are $10^3$ to $10^4$ ohms.

In order to obtain particular resistance values, different plastics may also be used for the two connecting lines 16, 17, that is to say plastics with different conductivity.

The connecting lines 16, 17 may also be formed only partially from conductive plastic, in particular if the other part of the connecting lines 16, 17 can be formed, for example, by a spectral configuration, for example, of the holding and connecting elements 14, 15.

The connecting lines 16, 17 are, of course, routed or covered such that it is impossible to touch any live parts.

Figure 2:
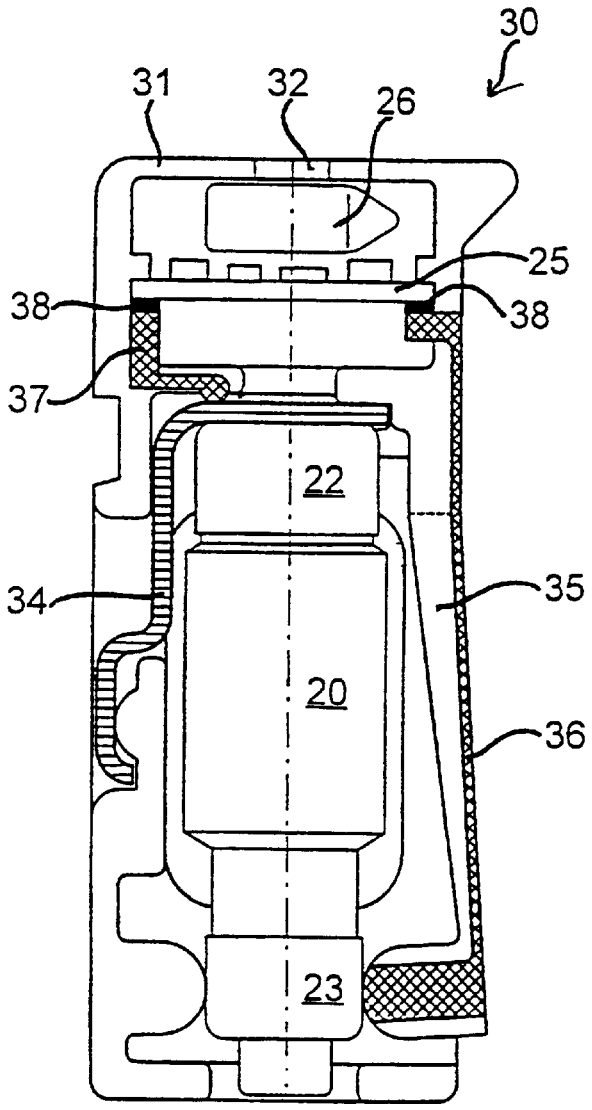
FIG. 2 shows a section view of a second version of a fuseholder having a built-in status indicator.
Figure 3:
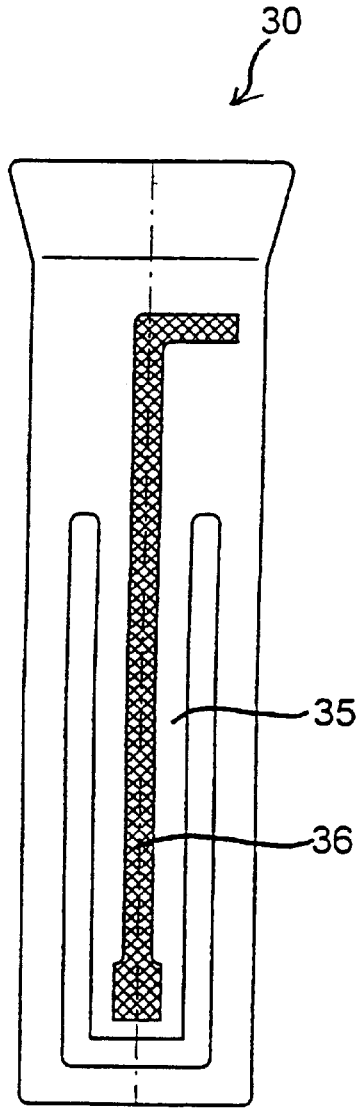
FIG. 3 shows a side view of the second version of the fuseholder.

FIGS. 2 and 3 show a second version of the fuseholder, which is denoted by the reference symbol 30. The version is intended for a fuse which has a separate on/off switch. Like the fuseholder 10, the fuseholder 30 also accommodates a fuse link 20 having a head contact 22 and a foot contact 23.

In this version of the fuseholder, only the head contact 22 of the fuse link 20 is connected to a holding and connecting element 34 of the fuseholder 30; the foot contact 23 of the fuse link 20 is, in contrast, free, and is directly connected to a corresponding contact in the fused switch.

However, a coding tongue 35 rests elastically against the foot contact 23 of the fuse link 20 and projects to a different extent from the housing of the fuse link 20 depending on the rating of the fuse, and thus the diameter of the foot contact 23, as is disclosed in Application DE 197 34 234.5.

The board 25 and the glow lamp 26 of the fuse status indicator are once again accommodated in the upper part 31 of the fuseholder 30, with the fuse status indicator being arranged behind a window 32.

As in the first version of the fuseholder, apart from the metallic holding and connecting element 34, the board 25, the glow lamp 26 of the status indicator and the window 32 (excluding the fuse link 20), the fuseholder 30 is once again composed of injection-molded plastic. In the electrically insulating plastic for the housing of the fuseholder 30, a channel is provided in the coding tongue 35, which rests elastically against the foot contact 23, and this channel is filled with an electrically conductive plastic, forming a first connecting line 36. The connecting line 36, composed of the electrically conductive plastic, is formed by means of two-component injection molding, as in the first version of the fuseholder. As can be seen from the section view in FIG. 2 and the view of the narrow side of the fuseholder 30 with the coding tongue 35 in FIG. 3, the connecting line 36 runs from the contact point between the coding tongue 35 and the foot contact 23 along the length through the coding tongue 35, and further onwards through the housing of the fuseholder 30 as far as the board 25.

Furthermore, another channel is provided in the housing of the fuseholder 30 between the board 25 and the holding and connecting element 34 for the head contact 22, and this channel is likewise filled with conductive plastic, forming a second connecting line 37.

Instead of making contact with the holding and connecting element 34, and connecting line 37 may in this case as an alternative also make direct contact with the head contact 22 of the fuse link 20.

The connecting lines 36, 37 are preferably once again connected to the board 25 via contact pieces 38, in such a way that, when the board 25 is inserted into the cavity in the upper part 31 provided for this purpose, this at the same time produces the electrical contact between the board 25 and the connecting lines 36, 37.

In this embodiment, the channels for the connecting lines 36, 37 may also be of a size such that they produce a specific electrical resistance, preferably between $10^3$ and $10^4$ ohms. Apart from this, various plastics may also be used for the two connecting lines 36, 37 for the fuseholder 30; and the connecting lines 36, 37 may be only partially composed of conductive plastic.

In both the described embodiments, the external shape of the fuseholder 10, 30 with the built-in status indicators corresponds exactly to the shape of fuseholders without status indicators, so that the fuseholders 10, 30 with the integrated connecting lines for the built-in status indicators can also be replaced by fused plugs without any status indicators even in already existing systems, without any work being required to the wiring and connections of the fused switch.

The electrically conductive plastics used may be plastics composed of polyphenylenesulfite which are mixed with carbon fibers in such a way as to comply with the requirements for the mechanical, thermal and electrical characteristics demanded of such electrically conductive, thermoplastic construction materials.

What is claimed is:

1. A fuseholder having a housing; and having a fuse status indicator with a board and a glow lamp; said housing configured to receive therein a fuse having a head contact and a foot contact; and said housing having at least one connecting line arranged to electrically connect the board of the fuse status indicator to at least one of the head contact and the foot contact of the fuse; wherein the housing of the fuseholder is produced from insulating plastic, and the housing has at least one channel for the connecting line between the board of the fuse status indicator and at least one of the head contact and the foot contact of the fuse; wherein said channel is filled with an at least partially conductive plastic to form said connecting line.

2. A fuseholder according to claim 1, wherein the channel for the connecting line has predetermined dimensions such that the channel length and the channel cross section result in a particular resistance when the conductive plastic of the connecting line has a given conductivity.

3. A fuseholder according to claim 1, wherein the connecting line is directly connected to the head contact and the foot contact of the fuse.

4. A fuseholder according to claim 1, wherein the connecting line is connected via a holding and connecting element of the fuseholder to the head contact and the foot contact of the fuse.

5. A fuseholder according to claim 1, wherein the fuseholder has a coding tongue which rests against the foot contact of the fuse, with the connecting line running through the coding tongue.

6. A fuseholder according to claim 1, comprising two connecting lines and two contact pieces, each contact piece located between a connecting line and the broad which make the contact between the connecting lines and the broad when the board is inserted into the fuseholder.

7. A fuseholder according to claim 1, wherein said connecting line comprises an injection molded conductive plastic.

8. A method for producing a fuseholder wherein the fuseholder comprises a housing, and a fuse status indicator with a broad and a glow lamp;

said housing configured to receive therein a fuse having a head contact and a foot contact; and said fuseholder having at least one connecting line arranged to electrically connect the board of the fuse status indicator to the head contact and foot contact of the fuse when the board is inserted into the housing;

comprising the steps of:

injection molding the housing of the fuseholder from insulating plastic, and forming a channel for the connecting line during injection molding; and depositing conductive plastic into the channel, in order to form the connecting line.

9. A method according to claim 8, wherein the housing and the connecting line are formed by two-component injection molding.

10. A method according to claim 8 wherein said conductive plastic is deposited into said channel by injection molding.

11. A fuseholder and fuse combination, comprising:

a replaceable fuse having a cylindrical casing surrounding a melting conductor, the melting conductor connected on opposite ends to a head contact and a foot contact;

a housing;

a fuse status indicator with a broad and a glow lamp;

said housing configured to receive said fuse therein, and said housing having at least one connecting line arranged to electrically connect the board of the fuse status indicator to at least one of the head contact and the foot contact of the fuse when inserted into the housing;

wherein said housing is substantially composed of insulating plastic, and the housing has at least one channel extending substantially between the board of the fuse status indicator and at least one of the head contact and the foot contact of the fuse; and said connecting line is located at least partially within said channel, and the connecting line is at least partially composed of a conductive plastic.

12. The combination according to claim 11, wherein said connecting line consists essentially of an injection molded conductive plastic.

13. The combination according to claim 11, wherein said at least one connecting line comprises a first connecting line arranged to make electrical contact with the fuse foot contact and a second connecting line arranged to make electrical contact with the head contact, both said first and second connecting lines being at least partially composed of conductive plastic; and said at least one channel comprises a first channel extending substantially between said board and said foot contact, said first connecting line located at least partially within said first channel, and a second channel extending substantially between said board and said head contact, said second connecting line located at least partially within said second channel.

14. The combination according to claim 13, wherein both said first and second connecting lines consist essentially of an injection molded conductive plastic.

* * * * *